US005964977A

United States Patent [19]

Sirdesai et al.

[11] Patent Number: 5,964,977

[45] Date of Patent: Oct. 12, 1999

[54] NAILWRAP COMPOSITION AND A METHOD OF APPLYING A NAILWRAP TO A HUMAN NAIL

[75] Inventors: Sunil J. Sirdesai, Irvine; Bernd Engelmann, Reseda; George Schaeffer, Beverly Hills, all of Calif.

[73] Assignee: OPI Products, Inc., North Hollywood, Calif.

[21] Appl. No.: 08/754,397

[22] Filed: Nov. 21, 1996

[51] Int. Cl.[6] ..... B32B 31/00; B05D 1/02; B05D 1/28

[52] U.S. Cl. ..... 156/280; 156/61; 156/305; 427/421; 427/341; 427/340; 427/429

[58] Field of Search ..... 132/73, 73.5, 385; 427/421, 341, 340, 429; 428/261, 272, 273, 288, 292, 424.4; 424/61, 70; 524/496, 700, 850; 156/61, 305, 280; 928/15, 16, 17; 63/42

[56] References Cited

U.S. PATENT DOCUMENTS

| | | | |
|---|---|---|---|
| 3,425,426 | 2/1969 | Welanetz . | |
| 4,157,095 | 6/1979 | Sweet . | |
| 4,260,701 | 4/1981 | Lee, Jr. | 525/303 |
| 4,299,243 | 11/1981 | Umstattd . | |
| 4,450,848 | 5/1984 | Ferrigno . | |
| 4,536,426 | 8/1985 | Massey . | |
| 4,646,765 | 3/1987 | Cooper et al. . | |
| 4,687,827 | 8/1987 | Russo | 427/340 |
| 4,860,774 | 8/1989 | Becker . | |
| 5,219,645 | 6/1993 | Schoon | 428/261 |
| 5,319,011 | 6/1994 | Schoon . | |

*Primary Examiner*—Lynette R. F. Smith
*Assistant Examiner*—Dat Quan Lee
*Attorney, Agent, or Firm*—Blakely Sokoloff Taylor & Zafman

[57] ABSTRACT

The invention relates to a method of applying a nailwrap to a human nail. The method includes depositing an effective amount of a polymerization catalyst on the nailwrap, placing the nailwrap on a portion of the nail, and depositing a first layer of a monomer over the nailwrap to simulate a human nail. By depositing the polymerization catalyst on the nailwrap, polymerization of the monomer occurs from the bulk, i.e., the surface of the human nail, and proceeds to the surface of the artificial nail structure. The invention also relates to a nailwrap for use on a human nail with a monomer to support an artificial nail structure. The nailwrap includes a woven fiber and an effective amount of a polymerization catalyst embedded in the fiber to substantially polymerize the monomer.

11 Claims, 1 Drawing Sheet

NAILWRAP COMPOSITION AND A METHOD OF APPLYING A NAILWRAP TO A HUMAN NAIL

FIELD OF THE INVENTION

This invention pertains to a method of catalytic curing of monomers used as overlays or nailwraps in the cosmetic industry to reinforce artificial fingernail and toenail extensions.

BACKGROUND OF THE INVENTION

Artificial nail structures are a part of a beauty regimen used by many women to impart a well groomed appearance. Artificial nail structures are generally worn on the fingernails of women and provide the appearance of longer nails than the otherwise natural nails. Artificial nail structures are also used to cover broken or weak nails.

The prior art reveals two classes of artificial nail structures. The first class of artificial nail structures are those structures applied as a viscous paste to a detachable and reusable or disposable form attached to the fingernail. These artificial nails are thicker in appearance than a natural nail and can be easily detected. The second class of artificial nail structures are pre-formed extensions that are attached to the nail with a glue and reinforced with a resin, typically with a cyanoacrylate ester resin. The pre-formed nail provides an artificial nail with considerably less thickness than acrylics and gives the nail a more natural look.

As described above, cyanoacrylate ester resins can be used alone to reinforce artificial nail structures. Though these cyanocrylate ester resin coatings are stronger than nail polish they are weaker than sculpted acrylics. Hence, the resins are generally reinforced to give the nails a healthy glow as well as strength to stand up to routine abuse encountered by the artificial nail structures during a normal day. Thus, these resins are typically reinforced with a fiberglass or fabric matrix. The pre-formed matrix is commonly referred to as a nailwrap or an overlay. The nailwrap typically extends over the natural nail and the artificial nail structure.

As described above, nailwraps are used to reinforce artificial nail structures. Nailwraps may also be used alone to reinforce and beautify natural nails.

The following protocols are normally used for applying a nailwrap to the fingernail. The protocols describe using a nailwrap to reinforce an artificial nail structure.

(i) If the nailwrap is self adhesive, the nailwrap structure is placed on the nail and cyanoacrylate ester monomer is spread on it to build the nail. A catalyst or accelerator dissolved in a volatile solvent is then sprayed or brushed or spread on top of this coating. The catalyst is essential in order to accelerate the curing (increase polymerization rate) of the monomer to form a resin. This monomer/catalyst procedure is then repeated.

(ii) If the nailwrap is not self adhesive, a thin layer of cyanoacrylate ester monomer is spread on the nail and the wrap is placed on it when the resin is in a tacky form. This is followed by the monomer/catalyst procedure described in protocol (i) and is repeated twice to build the nail.

In both protocols outlined above, the polymerization of the cyanoacrylate ester starts on the surface and proceeds into the bulk of the monomer, i.e., into the cyanoacrylate ester monomer and toward the surface of the fingernail. The main drawback with this procedure is that several growing polymer chains are terminated by atmospheric oxygen. This leaves some uncured monomer or oligomer in the "bulk" or at the interface between the artificial nailwrap structure and the fingernail. This uncured monomer/oligomer, having failed to achieve a high molecular weight necessary to impart adhesive properties, hinders the formation of bonds between the adherend (the cyanoacrylate ester resin) and the substrate (the natural fingernail). This leads to several points of high stress (defects) at the interface of the adherend and the substrate. Another reason for these defects is that polymerization begins at the surface and works inward. The monomer rushes to meet the growing polymer, and, as is the case with any polymerization, a degree of contraction occurs as the polymer is formed. This may result in the formation of minute air spaces between the cyanoacrylate resin and the nail. Through routine abuse of the artificial nail structures, the strain energy increases at stressed joints which leads to the gradual appearance of defects as the bond strength weakens between the adherend and the substrate. Rapidly, there comes a point when the strain energy is great enough and releases enough mechanical energy that it exceeds the force of the bonds holding the adherend and the substrate, and the artificial nail structure is chipped or lifted from the natural nail.

Various methods have been designed to attempt to remedy or alleviate this chipping and lifting problem. U.S. Pat. No. 3,425,426, issued to Welanetz (1969) discusses a nail repair provided by a patch material impregnated with a binding solution, i.e., cellulose nitrate, that is a solvent activatable to adhere the nail patch to the nail. The patent of Welanetz provides a cure after the malady has occurred and it does not attempt to prevent the occurrence of the aforementioned drawback.

U.S. Pat. No. 4,299, 243 issued to Umstattd (1981) seeks to remedy the chipping and lifting problem limitation by impregnating the reinforcing material with a quick-drying adhesive.

U.S. Pat. No. 4,450,848 (1984), issued to Ferrigno does not use a reinforcing material but instead uses a clear powder containing acrylic ester polymers and benzoyl peroxide. This solution fails to address the problems caused by initiating the polymerization on the top surface of the artificial nail structure.

U.S. Pat. No. 4,646,765 issued to Lilling (1987) discusses the use of graphite fibers in the cyanoacrylate resin. This procedure yields a final structure that still contains uncured monomers/oligomers at the interface between the adherend and the substrate.

U.S. Pat. No. 4,860,774 issued to Talerico (1989) suggests impregnating the nailwrap with a suspension of resin polymer and monomer. The impregnated wrap is then coated with pressure sensitive adhesive followed by the application of fast drying cyanoacrylate adhesive. The curing process is initiated by moisture in the atmosphere. The patent of Talerico does not provide any remedy that would promote the curing of monomers in the interface of the artificial nail and the natural nail.

U.S. Pat. Nos. 5,219,645 and 5,319,011 issued to Schoon (1994) discuss impregnating the fabric matrix with a cyanoacrylate monomer. This monomer is then cured by a cationic polymerization using a liquid containing organotin compounds. This would be very difficult because electron withdrawing groups, i.e., the cyano and ester groups on cyanoacrylate ester, make the formation of a stable carbocation on the terminal methylene of the acrylate moiety virtually impossible. It is well known that unless the conditions are conducive to the formation of a stable carbocation, it is very difficult to carry out cationic polymerization. The polymerizations of the type mentioned in Schoon can therefore only be carried out with great difficulty using extreme reaction conditions like very high pressure in an explosion proof vessel. Hence Schoon does not provide a solution to the existing dilemma, i.e., of chipping and lifting of the artificial nail structure from the natural nail.

As noted, all the prior art procedures have failed to provide a solution to reduce or eliminate the defects on the interface of the nail (i.e., between the artificial nail structure and the natural nail). There exists a need for a better methodology to promote polymerization and cure the cyanoacrylate ester monomers on the interface.

SUMMARY OF THE INVENTION

The invention relates to a method of applying a nailwrap to a human nail. The method includes depositing an effective first amount of polymerization catalyst on the nailwrap, placing the nailwrap on a portion of a human nail, and depositing an effective amount of a monomer, preferably a cyanocrylate monomer, over the nailwrap to form a first layer. The nailwrap may include a self-adhesive to bond to the human nail. Alternatively, the nailwrap may be affixed to a human nail after the application of an effective amount of the catalyst and monomer on a portion of the nail to substantially affix the nailwrap to the nail.

The invention also relates to a nailwrap for use on a human nail with a monomer to support an artificial nail structure. The nailwrap includes a woven fiber and an effective amount of polymerization catalyst embedded in the fiber to substantially polymerize the monomer. Suitable woven fiber includes fiberglass and other fabrics. The catalyst is preferably comprised of a nucleophilic compound. The nailwrap of the invention may further include an adhesive to substantially attach the nailwrap to a human fingernail.

The technique and nailwrap disclosed herein promote complete bulk polymerization of the monomer on the nail resulting in virtual elimination of uncured monomer or minute air spaces on the interface and minimizes the defects that occur on the interface.

DETAILED DESCRIPTION OF THE INVENTION

The invention relates to a method of applying a nailwrap to a human nail. The nailwrap may be used as an overlay to impart strength to the natural human nail. The invention also relates to a nailwrap for use on a human nail with a monomer to support an artificial nail structure. The invention is described below with reference to the enclosed figures.

Figure 1:
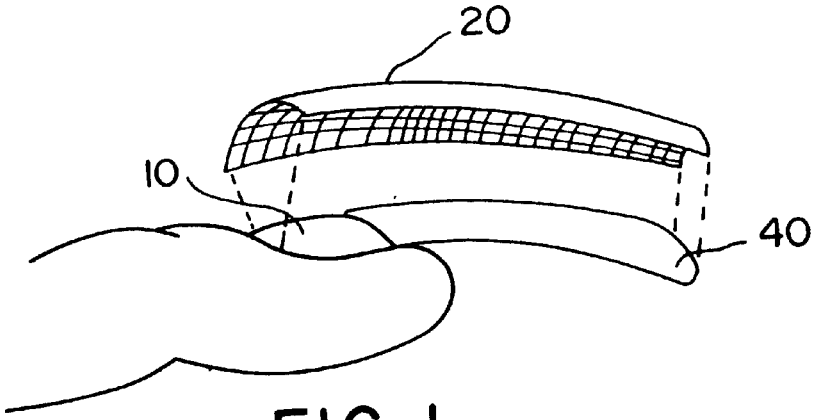
FIG. 1 is an exploded perspective side view of a portion of a human finger with an artificial nailwrap extension structure.

FIG. 1 illustrates an exploded side perspective view of the nailwrap 20 of the invention attached to a human fingernail 10 and supporting an artificial nail structure 40. AS illustrated in FIG. 1, the nailwrap 20 extends over both the natural nail 10 and a portion (typically the majority) of the artificial nail structure 20.

The method includes depositing an effective amount of a polymerization catalyst on the nailwrap, placing the nailwrap on a portion of a human nail, and depositing a layer of a monomer over the nailwrap which polymerizes to simulate a human nail. By depositing the polymerization catalyst on the nailwrap prior to placing the nailwrap on a portion of a human nail, the invention initiates the polymerization of the monomer from the human nail to the surface. The process of curing, i.e., polymerizing, proceeds to the surface to yield a structure that is substantially completely polymerized with a minimum amount of defects, if any, at the interface between the artificial nail structure and the natural nail.

The polymerization catalyst contemplated for use in the invention is preferably related to one of a family of nucleophilic compounds. These compounds contain electron donating groups. Suitable compounds are preferably those bases or neutral molecules capable of donating non-bonding electrons. Examples of catalysts that will work in the invention include, amines, ammonia, and thiol compounds. Specific catalysts include, but are not limited to, dimethyl p-toluidine, dimethyl aniline, thiocarbamyl sulfenamide, and morpholine.

The invention contemplates that the nailwrap is made of a woven fiber. The use of a woven fiber allows the fiber to be impregnated with the polymerization catalyst so that polymerization may proceed from the human nail to the surface of a subsequent resin layer. The fiber also serves as the reinforcement for the resin layer that is subsequently applied to simulate a human nail. The fiber contemplated generally include the natural fibers, semi-synthetic fibers, and synthetic fibers. Examples of natural fibers are the animal fibers and cotton. Semi-synthetic fibers include rayon. Synthetic fibers include polyesters, polyamides, acrylics, and fiberglass.

The invention contemplates that an effective amount of a monomer is deposited over the nailwrap to form a first layer. The invention contemplates that cyanoacrylate monomers are preferably used as the monomers that substantially form the nailwrap or overlay. The invention should not, however, be limited to nailwraps for use with cyanoacrylate monomers. The invention contemplates a method of use and a nailwrap apparatus for use with any compatible monomer/catalyst suited for use over a natural nail or with artificial nail compositions. Other monomer/catalyst combinations include acrylate or methacrylate monomers containing amine additives, e.g., p-toluidine with peroxide catalysts.

The cyanoacrylate monomer is applied to the outer surface of the nailwrap. The presence of the polymerization catalyst causes the cyanoacrylate ester monomers to begin to polymerize to form a polymeric structure on the human nail. By placing the catalyst on the wrap, the polymerization starts in the wrap or on the human nail and continues outward toward the surface forming the resin. Such a process allows complete polymerization of the cyanoacrylate ester monomers. The resulting product contains stronger bonds (both intermolecular and intramolecular) to produce stronger and harder overlays with excellent adhesion. The structure created in this fashion will exhibit minimal breakage or separation from the natural nail.

Polymerization begins from the bulk, i.e., the interface. The monomer from the outside is drawn toward the interface resulting in the formation of a densely packed structure at the interface and elimination of interstices that would occur had the polymerization begun at the outside. By initiating the polymerization (i.e., growing the polymer chains) from the bulk, and proceeding to the surface of the artificial nail structure, the polymerizing chains do not encounter atmospheric oxygen or air that are inhibitors that limit the polymerization ability of the compound by terminating growing polymer chains. Such a technique approximately mimics a polymerization carried out in a laboratory setting in a vacuum or an inert atmosphere. Hence, the invention yields complete polymerization and virtually eliminates any lifting or separation of the overlay or, in the case of the use of a nailwrap to strengthen an artificial nail structure, of the artificial nail structure from the natural nail.

The following examples illustrate a method of formation of the nailwrap with the polymerization catalyst and application of the nailwrap/resin/catalyst to a human nail with or without an artificial nail structure.

EXAMPLE 1

Nailwrap Structure

The nailwrap structure of the invention is created by first creating a solution of the polymer catalyst by dissolving 0.1–30% by weight of the catalyst in a volatile solvent. Representative catalysts that will work in this manner include, amines, ammonia, and thiol compounds. The volatile solvents are preferably selected from those halogenated solvents, oxygenated solvents, and hydrocarbon solvents. Representative examples include dichloromethane, ethanol, ethylacetate, petroleum ether, and heptane. The volatile solvents act as the vehicles to deposit the catalyst on the surface of the nailwrap.

Figure 2:
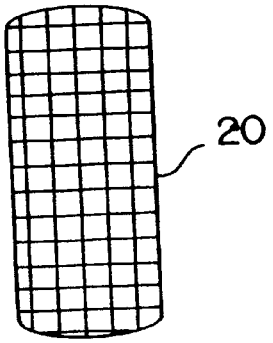
FIG. 2 is a planar front view of a non-biased nailwrap structure of the invention.
Figure 3:
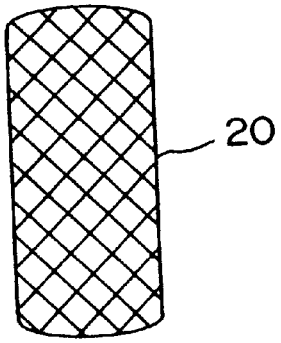
FIG. 3 is a planar front view of a biased nailwrap structure of the invention.

Once the solution is formed, the wrap, preferably a biased or non-biased fabric or fiberglass wrap, is dipped into the solution and allowed to dry. The dry time is almost instantaneous. Alternatively, the wrap is sprayed with the solution and allowed to dry. FIG. 2 illustrates a planar front view of a non-biased nailwrap 20 of the invention. FIG. 3 illustrates a planar front view of a biased nailwrap 30 of the invention.

Figure 4:
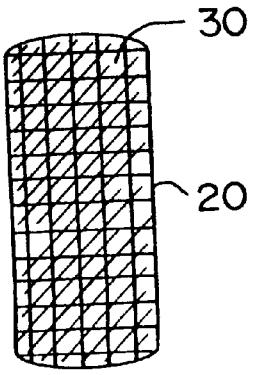
FIG. 4 is a planar rear view of the nailwrap structure which includes an adhesive to attach the nailwrap to a human nail.

A self-adhesive version of this wrap is prepared by spraying a thin non-continuous layer of non-bonding, pressure sensitive adhesive on one side of the wrap and marrying this side with a wax paper or silicon liner. FIG. 4 illustrates a planar rear view of the non-biased nailwrap 20 of the invention. The nailwrap in FIG. 4 includes a self-adhesive component or layer 30. The self-adhesive component can be a blend of elastomers like natural rubber and butadiene-styrene copolymers (SBR) or block copolymers of styrene with isoprene or butadiene or acrylic ester copolymers or polyisobutylene.

The self-adhesive or non-self-adhesive wrap is then placed on the nail and cut to approximately the size and shape of the existing nail with or without an artificial nail structure/extension. Both the self-adhesive and the non-self-adhesive nailwraps are ready to be used by manicurists or other persons to apply to a human nail.

EXAMPLE 2

Application of Self-Adhesive Nailwrap to Nail

Example 2 illustrates the steps in the application of a self-adhesive nailwrap to a human nail.

(1) The self-adhesive nailwrap impregnated with catalyst but with most of its interstices open (i.e., the majority of the catalyst resides on the thread of the nailwrap fabric), is placed on a nail prepared for manicure.

(2) Cyanoacrylate ester monomer is then spread on the nailwrap to form a layer. The layer is allowed to cure. Catalyst present in the nailwrap starts curing this monomer immediately so that the polymerization/curing/drying occurs rapidly.

(3) Additional polymerization catalyst is then brushed or sprayed on the layer in Step (2). This catalyst will catalyze a second layer of cyanoacrylate ester monomer that will be applied in the subsequent step.

(4) A second layer of cyanoacrylate ester monomer is then spread on the nailwrap. The layer is allowed to cure and cures/dries quickly. The catalyst applied in Step (3) starts curing this layer immediately.

(5) Steps (3) and (4) may optionally be repeated at the discretion of the manicurist.

(6) The artificial nail is then filed and buffed. A base coat and top coat are optionally applied to sport a natural finished look. Alternatively, base coat, 2 layers of nail polish, and a top coat are applied.

EXAMPLE 3

Application Techniaue for Non-Self-Adhesive Nailwrap to Nail

Example 3 illustrate the steps in the application of a non-self-adhesive nailwrap to a human nail.

(1) The catalyst is spread on a portion of the nail prepared for cyanoacrylate ester monomer.

(2) The cyanoacrylate ester monomer is spread on the nail. The nailwrap, impregnated with catalyst but with most of its interstices open (i.e., the catalyst resides on the threads of the wrap), is immediately placed on the tacky surface. The catalyst from Step (1) will cure the underlying monomer while the catalyst sitting on the wrap away from the tacky adhesive surface remains substantially intact and available for use.

(3) The cyanoacrylate ester monomer is then spread on the nailwrap to form a layer. The layer dries/cures quickly. The catalyst in the nailwrap starts curing this layer immediately.

(4) The catalyst is then brushed or sprayed or spread on the layer produced in Step (3).

(5) A second layer of cyanoacrylate ester monomer is then spread. The catalyst from Step (4) starts curing this layer immediately. The layer dries/cures quickly.

(6) Steps (4) and (5) may optionally be repeated at the discretion of the manicurist.

(7) The artificial nail is then filed and buffed. A base coat and top coat are optionally applied to sport a natural finished look. Alternatively, base coat, 2 layers of nail polish, and a top coat are applied.

In the preceding detailed description, the invention is described with reference to specific exemplary embodiments thereof. Further, the description made reference to commercially available components for use in embodiments of the invention. It will, however, be evident to those of ordinary skill in the art that various modifications and changes may be made there to without departing from the broader spirit and scope of the invention as set forth in the claims. The specification is to be regarded in an illustrative rather than a restrictive sense.

What is claimed is:

1. A method of applying a nailwrap to a nail, the method comprising the steps of:

depositing an effective first amount of a polymerization catalyst on the nailwrap;

placing the nailwrap on an area of a nail;

depositing an effective amount of a monomer over the nailwrap to form a first layer; and allowing the monomer to polymerize.

2. The method of claim 1, after the step of allowing the monomer to polymerize, further comprising the steps of:

depositing an effective second amount of the polymerization catalyst over the first layer; and depositing a second layer of the monomer over the nailwrap after the step of depositing an effective second amount of the polymerization catalyst.

3. The method of claim 1, wherein before the step of placing the wrap on the nail, the method comprises the steps of:

depositing an effective first amount of a polymerization catalyst on a first area of the nail; and depositing a layer of a monomer over a second area of the nail, the second area including to a portion of the first area.

4. The method of claim 1, wherein the nailwrap is a woven fiber.

5. The method of claim 4, wherein the woven fiber is selected from the group consisting of fiberglass and fabric.

6. The method of claim 1, wherein the monomer is a cyanoacrylate monomer.

7. The method of claim 1, wherein the catalyst is a nucleophilic compound.

8. The method of claim 7, wherein the catalyst is selected from the group consisting of amines, ammonia, and thiol compounds.

9. The method of claim 7, wherein the catalyst is further comprised of a volatile solvent and wherein the nucleophilic compound is present in an amount of about 0.1–30% by weight and said solvent is present in an amount of about 70–99.9% by weight.

10. The method of claim 9, wherein the solvent is selected from the group consisting of a halogenated solvent, an oxygenated solvent, and a hydrocarbon solvent.

11. The method of claim 1, wherein the nail is a natural nail with an artificial nail extension coupled to the nail and wherein the step of placing the nailwrap on a portion of a nail includes placing the nailwrap on a portion of the natural nail and a portion of the artificial nail extension.

* * * * *

UNITED STATES PATENT AND TRADEMARK OFFICE

CERTIFICATE OF CORRECTION

PATENT NO. : 5,964,977

DATED : October 12, 1999

INVENTOR(S) : Sirdesai et al.

It is certified that error appears in the above-identified patent and that said Letters Patent is hereby corrected as shown below:

In column 3, line 62, delete "AS illus-" and insert -- As illus- --.

In column 6, line 21, delete "Application Techniaue for" and insert -- Application Technique for --.

Signed and Sealed this

Twentieth Day of March, 2001

*Attest:*

Nicholas P. Godici

NICHOLAS P. GODICI

*Attesting Officer*

*Acting Director of the United States Patent and Trademark Office*